US006446956B1

(12) United States Patent
Sato et al.

(10) Patent No.: US 6,446,956 B1
(45) Date of Patent: Sep. 10, 2002

(54) PAPER DISCHARGE DEVICE FOR A PRINTER

(75) Inventors: Hitoshi Sato, Tokyo; Shinichi Miyashita, Yamanashi-ken, both of (JP)

(73) Assignee: Japan CBM Corporation, Tokyo (JP)

( * ) Notice: Subject to any disclaimer, the term of this patent is extended or adjusted under 35 U.S.C. 154(b) by 0 days.

(21) Appl. No.: 09/916,223

(22) Filed: Jul. 27, 2001

(30) Foreign Application Priority Data

Jul. 27, 2000 (JP) ..... 2000-228005

(51) Int. Cl.[7] ..... B65H 43/00

(52) U.S. Cl. ..... 271/176; 271/265.02; 271/275; 271/314; 271/902

(58) Field of Search ..... 271/902, 265.02, 271/275, 272, 314, 176

(56) References Cited

U.S. PATENT DOCUMENTS 4,056,263 A * 11/1977 LaWhite et al. ..... 271/275
4,704,518 A * 11/1987 Brunn et al. ..... 271/275
5,171,006 A * 12/1992 Naito ..... 271/902
6,105,953 A * 8/2000 Komuro ..... 271/275

* cited by examiner

*Primary Examiner*—H. Grant Skaggs
(74) *Attorney, Agent, or Firm*—Dennison, Schultz & Dougherty

(57) ABSTRACT

A paper discharge device for a printer has a housing having a circular inside guide wall, a paper inlet, a paper taking out opening, a paper discharge opening, and a paper discharge space. A paper winding roll is rotatably provided in a space inside the circular inside guide wall. A paper introducing roller is provided for introducing a paper sheet into the paper winding roll, and a paper discharge roller is provided for discharging the paper sheet in the paper discharge space. A first sensor is provided for detecting a rear end of the paper sheet when the paper sheet is fed to the paper discharge opening, and a second sensor is provided for detecting a forward end of the paper sheet when the paper sheet is fed to the paper taking out opening. In response to output signals of the first and second sensors, the rotation of the paper winding roll is controlled.

3 Claims, 10 Drawing Sheets

PAPER DISCHARGE DEVICE FOR A PRINTER

BACKGROUND OF THE INVENTION

The present invention relates to a paper discharge device for a printer used in the ticket vending machine installed in the station, convenience store and others.

In a conventional paper discharge device, a paper accumulation space is provided between a printer and a discharge opening so that a paper sheet is slackened in the space in order to prevent the paper from being pulled out by a user.

Japanese Patent Laid Open 7-76446 discloses the above described prior art, and FIGS. 8 to 10 show the prior art.

Referring to FIGS. 8 and 9, paper sheet 205 is fed by a paper feeder 201 and a printer 202 prints letters on the paper sheet. When the forward end of the paper sheet 205 is detected by an optical sensor 204*a,* a discharge roller 204*c* stops.

However, the paper feeder 201 continues to feed the paper and the printer 202 continues the printing. Consequently, the paper sheet 205 is bent in a U-shape and the loop becomes large as 205*a,* 205*b,* and 205*c* in a paper accumulation space 204*b.*

When the printing ends, a cutter 203*a* is downwardly moved to cut the paper as shown in FIG. 9.

When the paper is cut by the cutter 203*a,* the discharge roller 204*c* rotates to discharge the paper. When the optical sensor 204*a* detects the passing of the end of the paper sheet, the paper feeder stops (FIG. 10).

In the conventional printer, the paper accumulation space 204*b* is inevitably provided. As is understood from the drawings, the space 204*b* occupies a large space in the printer, which causes the size of the printer to enlarge. Furthermore, the shape of the paper in the accumulation space is liable to change with the quality of the paper and the humidity of the atmosphere, which causes the printer to be choked with the paper. In particular, thick paper may not be formed into a proper shape, and hence the printer is not properly operated.

SUMMARY OF THE INVENTION

Accordingly, an object of the present invention is to provide a paper discharge device having a small size.

Another object of the present invention is to provide a paper discharge device which is not choked with paper.

According to the present invention, there is provided a paper discharge device for a printer comprising a housing having a circular inside guide wall, a paper inlet, a paper taking out opening, a paper discharge opening, and a paper discharge space, a paper winding roll rotatably provided in a space inside the circular inside guide wall, a motor for rotating the paper winding roll, a power transmitting device for transmitting power of the motor to the paper winding roll, pressure rollers pressed against a periphery of the paper winding roll for winding a paper sheet on the paper winding roll, the pressure rollers including a paper introducing roller and a paper discharge roller for discharging the paper sheet in the paper discharge space, a first sensor for detecting a rear end of the paper sheet when the paper sheet is fed to the paper discharge opening, a second sensor for detecting a forward end of the paper sheet when the paper sheet is fed to the paper taking out opening, and control means responsive to output signals of the first and second sensors for controlling operation of the motor.

The device further comprises a transmission power limit means provided in the power transmitting device for cutting the power transmission when an excessive load is applied on the paper winding roll, and a guide plate for guiding the forward end of the paper sheet into the paper discharge space.

These and other objects and features of the present invention will become more apparent from the following detailed description with reference to the accompanying drawings.

DETAILED DESCRIPTION OF THE PREFERRED EMBODIMENT

Figure 1:
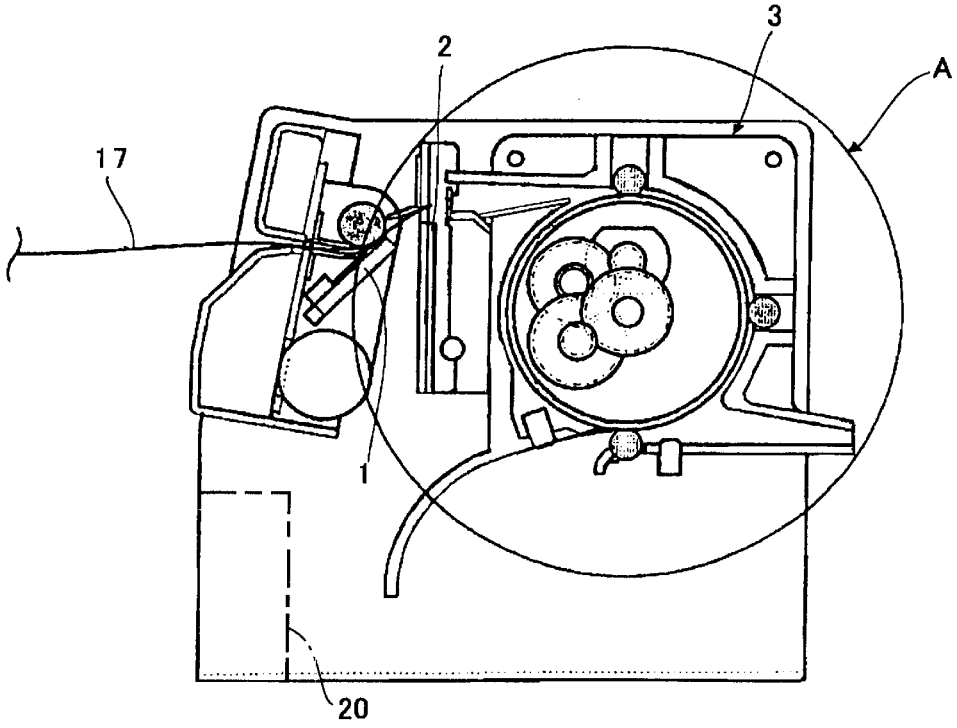
FIG. 1 is a sectional view of a ticket vending machine provided with a paper discharge device of the present invention.

Referring to FIG. 1 showing a ticket vending machine, a paper sheet 17 is fed to a printer 1 where letters are printed on the paper sheet 17 by the printer 1. The printed paper sheet is cut by a cutter 2 and discharged by a paper discharge device 3.

Figure 2A:
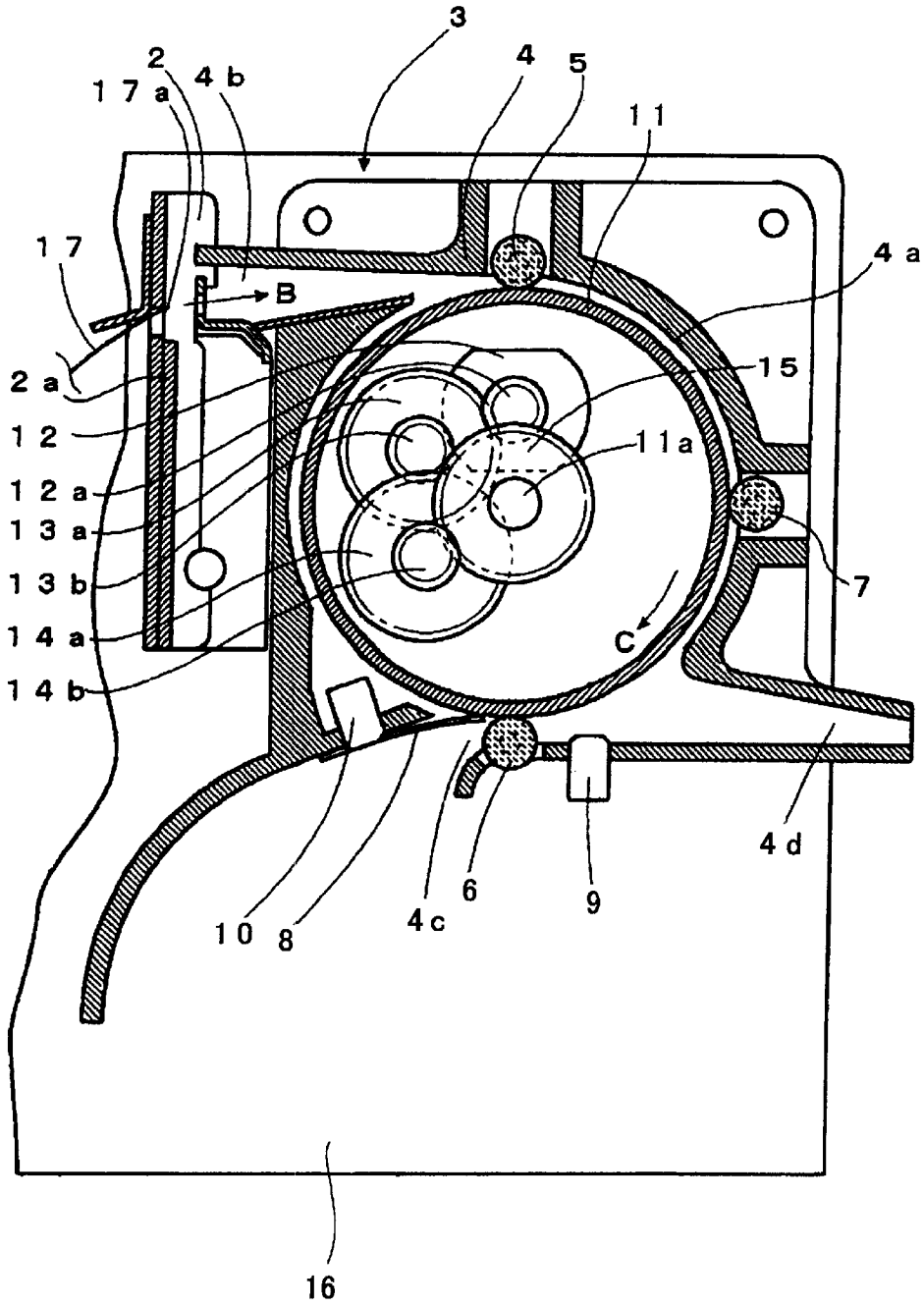
FIG. 2*a* is an enlarged sectional view of a part A in FIG. 1.

Referring to FIG. 2*a* showing the cutter 2 and the paper discharge device 3, a blade 2*a* is vertically movably provided in the cutter 2. The paper discharge device 3 has a housing 4 in which a circular inside guide wall 4*a* is formed so as to surround a paper winding roll 11. The paper winding roll 11 is rotatably mounted in the housing 4 by a shaft 11*a*. There is formed a paper inlet 4*b,* a paper discharge opening 4*c,* a paper taking out opening 4*d* in the housing 4.

The shaft 11*a* of the paper winding roll 11 is connected to a drive shaft of a motor 12 through a reduction gear train comprising small gears 12*a,* 13*b* and 14*b* and large gears 13*a,* 14*a* and 15.

Figure 2B:
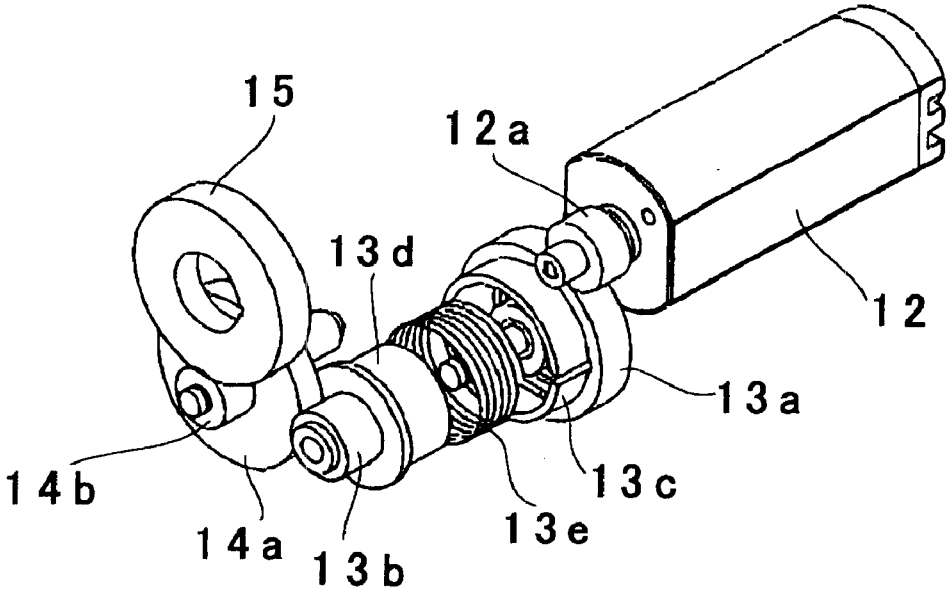
FIG. 2*b* is a perspective view of a reduction gear train a part of which is exploded.

Referring to FIG. 2*b* showing the reduction gear train, the large gear 13*a* has an outer cylinder 13*c* and the small gear 13*b* has an inner cylinder 13*d.* The cylinders 13*c* and 13*d* are slidably engaged through a cluctch spring 13*e* so that the rotation of the gear 13*a* is transmitted to the gear 13*b* by the friction of the clutch spring 13*e.* If an excessive load is applied to the paper winding roll 11, the clutch spring 13*e* slips, so that the paper winding roll 11 stops. Namely, in the reduction gear train, a transmission power limit means is provided.

An introducing pressure roller 5 is provided to be pressed against the paper winding roll 11 at a position adjacent the paper inlet 4*b,* an intermediate pressure roller 6 is provided adjacent the paper discharge opening 4*c,* and a paper discharging pressure roller 7 is provided adjacent the paper taking out opening 4*d.*

A first optical sensor 9 is provided adjacent the second pressure roller 6, and a second optical sensor 10 is provided in a paper discharge space 16 at a position outside the second pressure roller 6. Each of the optical sensors 9, 10 comprises a light emitting decode and a phototransistor. A guide plate 8 is provided in the paper discharge space 16 for guiding the paper in the space.

Figure 3:
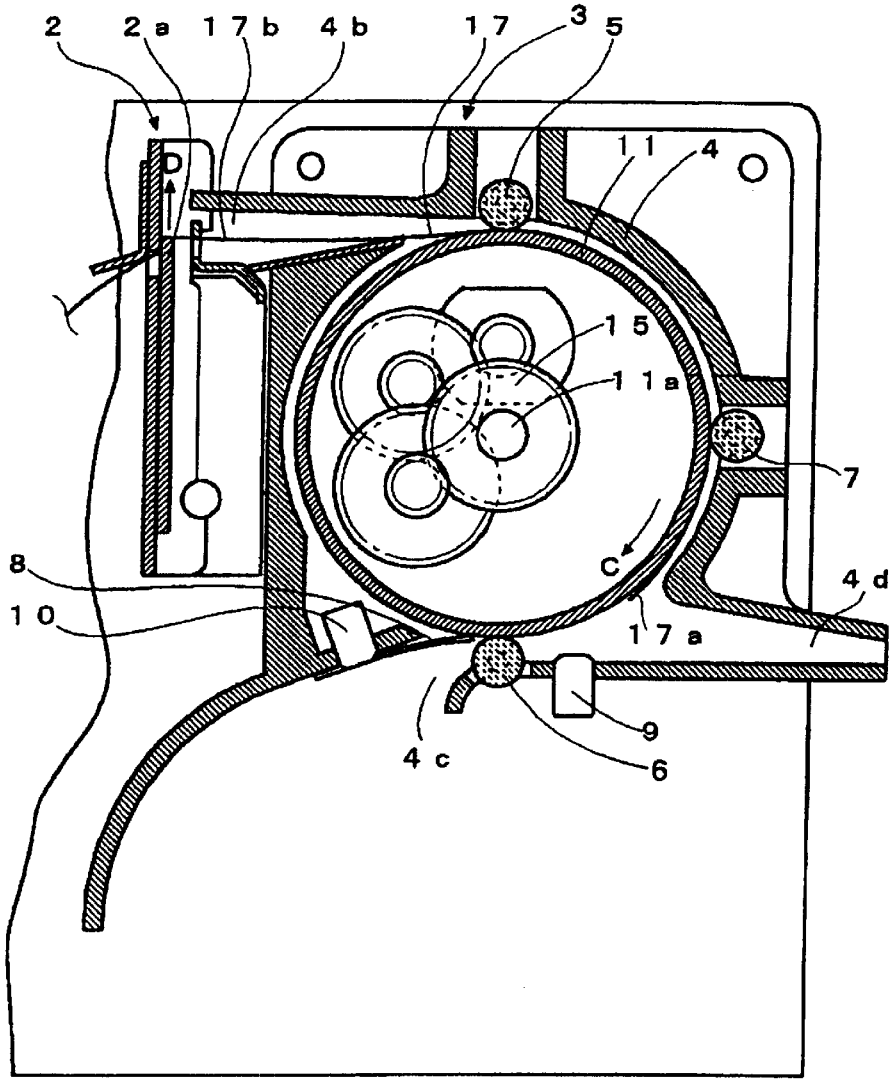
FIGS. 3 to 7 are sectional views for explaining the operation of the paper discharge device.

In FIG. 1, when the printer 1 starts to print letters on the paper sheet 17, the paper sheet is fed passing through the printer. The discharged sheet 17 is inserted in the paper inlet 4*b* and passes the cutter 2 as shown in FIG. 2*a*. At that time, the motor 12 is started so that the paper winding roll 11 is rotated through the reduction gear train 15 in the direction of the arrow C. Accordingly, the paper sheet 17 is fed by the first pressure roller 5 and the third pressure roller 7, while the sheet is wound on the paper winding roll 11. When the printer 1 finishes the printing, the motor 12 is stopped to stop the paper winding roll 11 and the cutter 2 is operated to cut the paper sheet by moving the blade 2*a* in a direction D of FIG. 3 by the controlling of a control circuit in a control system 20 (FIG. 1).

Figure 4:
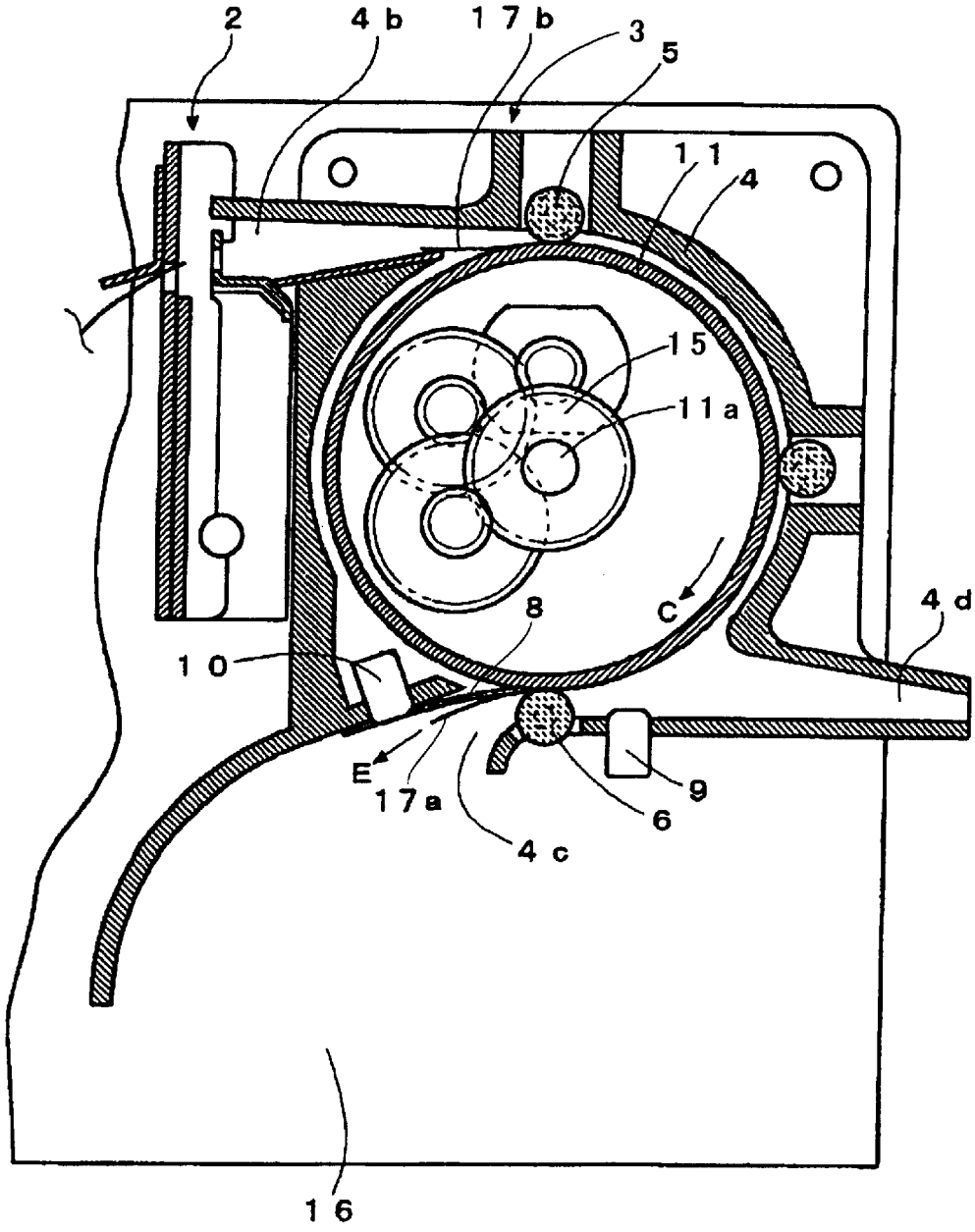

When the paper sheet 17 is cut, the motor 12 is re-started. Thus the sheet 17 is further fed by the second pressure roller 6. As shown in FIG. 4, the forward end 17*a* is fed in the direction E by the guiding of the guide plate 8. Hence the paper sheet 17 is fed in the paper discharge space 16.

Figure 5:
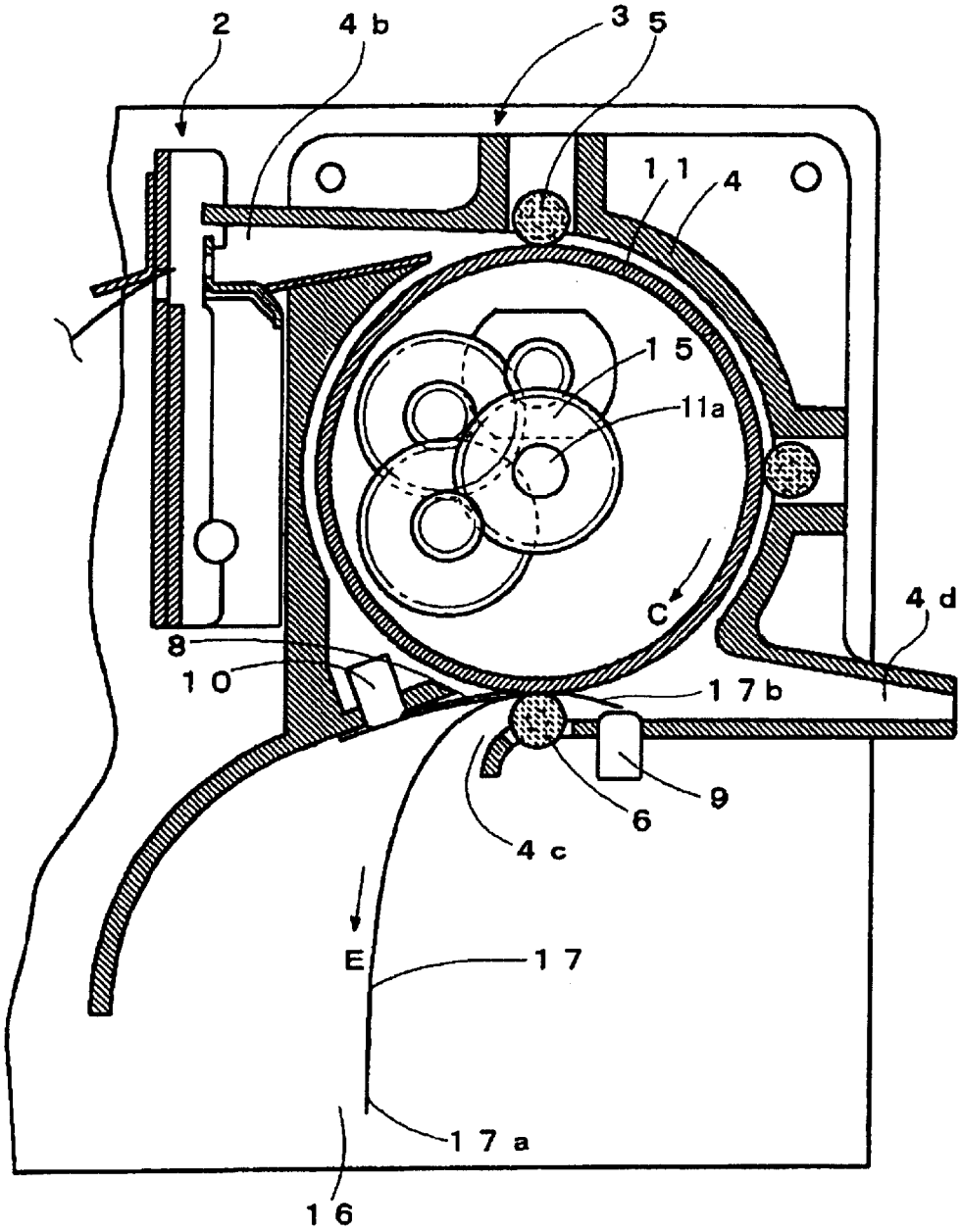

When the rear end 17*b* passes the first optical sensor 9, the sensor produces an output signal. In accordance with the signal, the control circuit stops the motor 12 to stop the paper winding roll 11 (FIG. 5).

Figure 6:
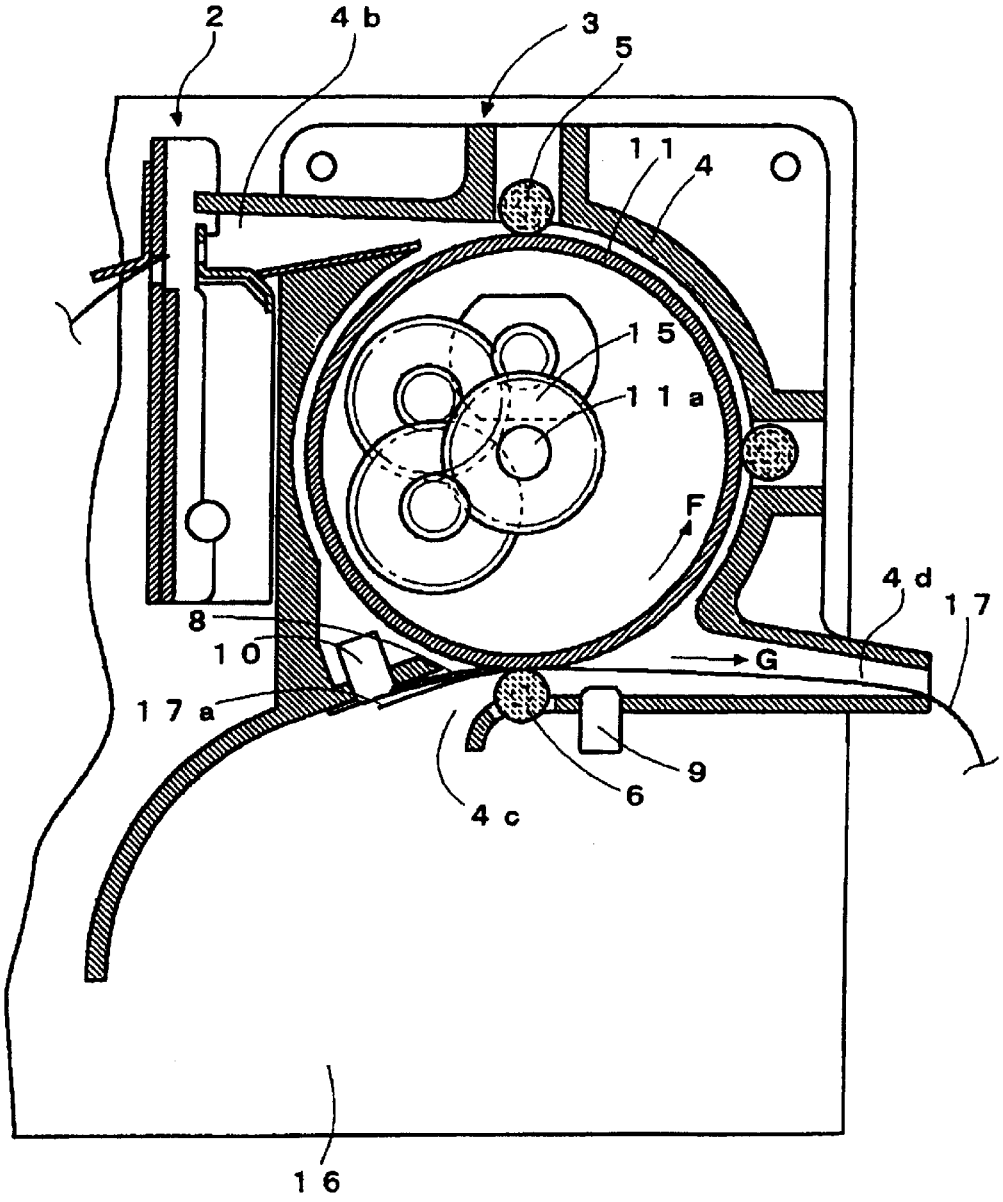

Next, the motor 12 is rotated in the reverse direction to rotate the paper winding roll 11 in the direction F of FIG. 6. Consequently, the paper sheet 17 nipped by the second pressure roller 6 and the paper winding roll 11 is fed in the reverse direction G, and the rear end of the paper sheet projects from the paper taking out opening 4*d*. When the second optical sensor 10 detects the passing of the forward end 17*a*, the motor 12 is stopped to stop the paper winding roll 11. Thus, the user can take out the printed paper sheet 17 from the opening 4*d*.

Figure 7:
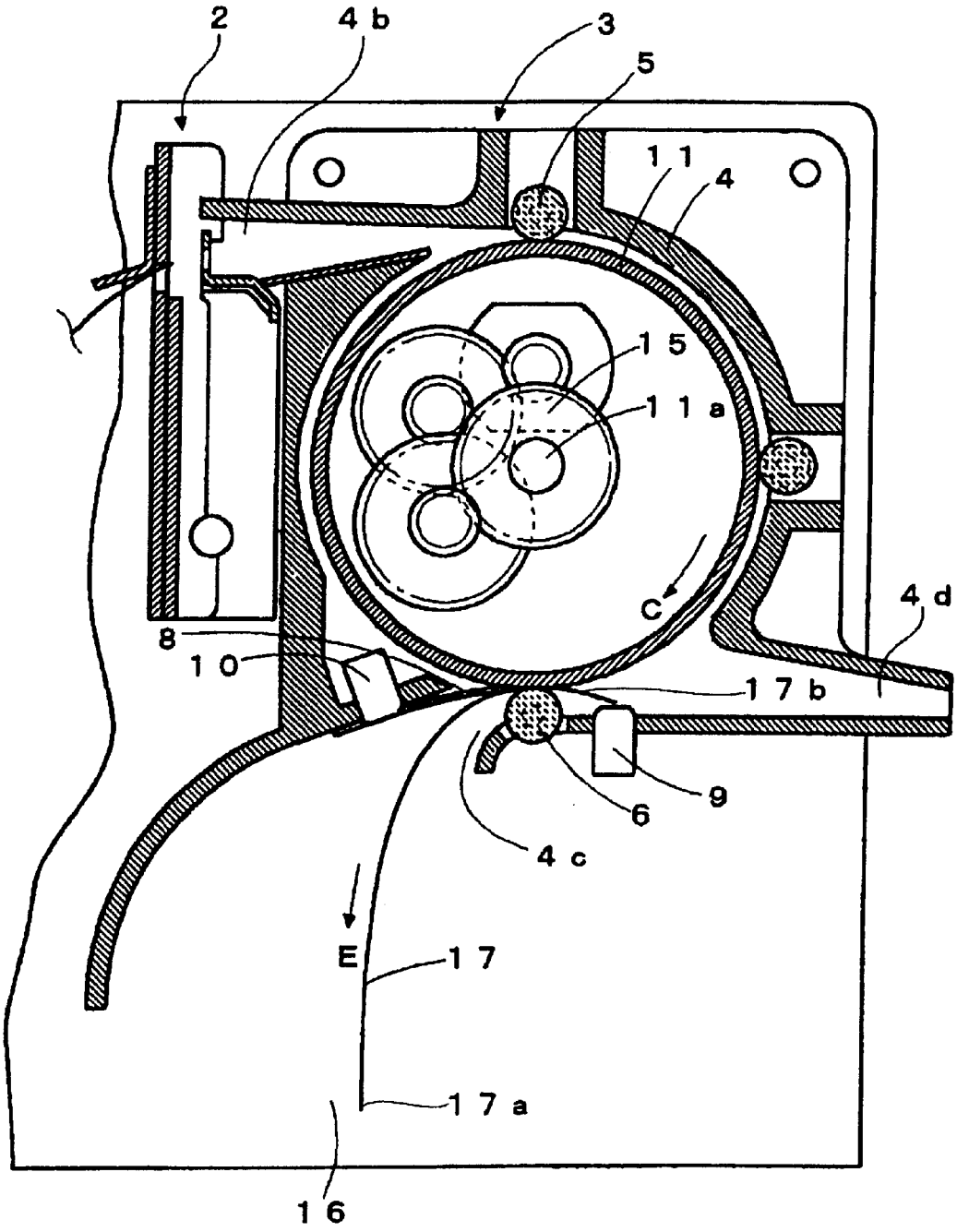
Figure 8:
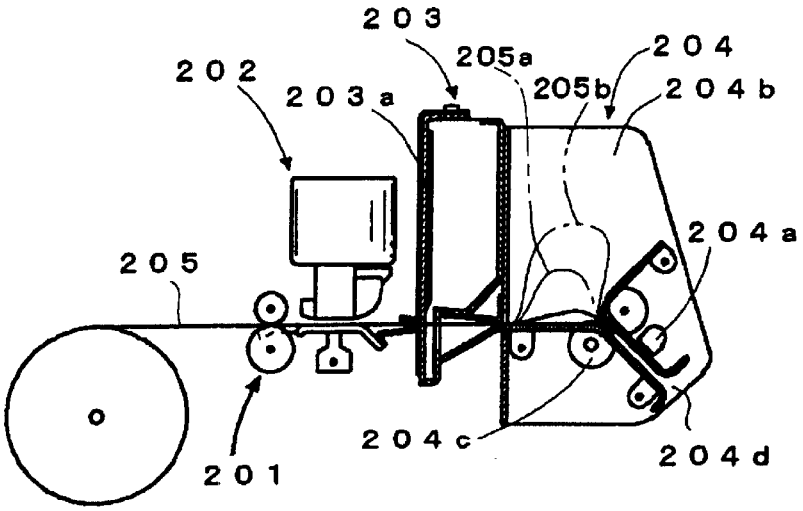
FIG. 8 PRIOR ART
FIGS. 8 to 10 are sectional views of a conventional printer.
Figure 9:
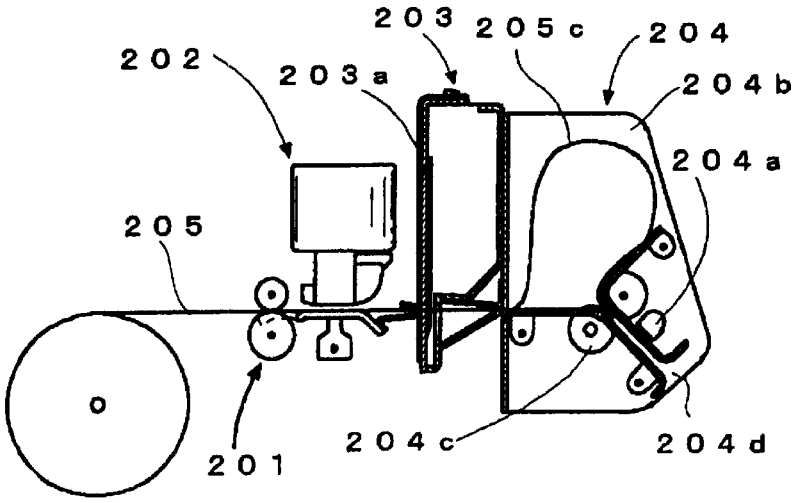
FIG. 9 PRIOR ART
Figure 10:
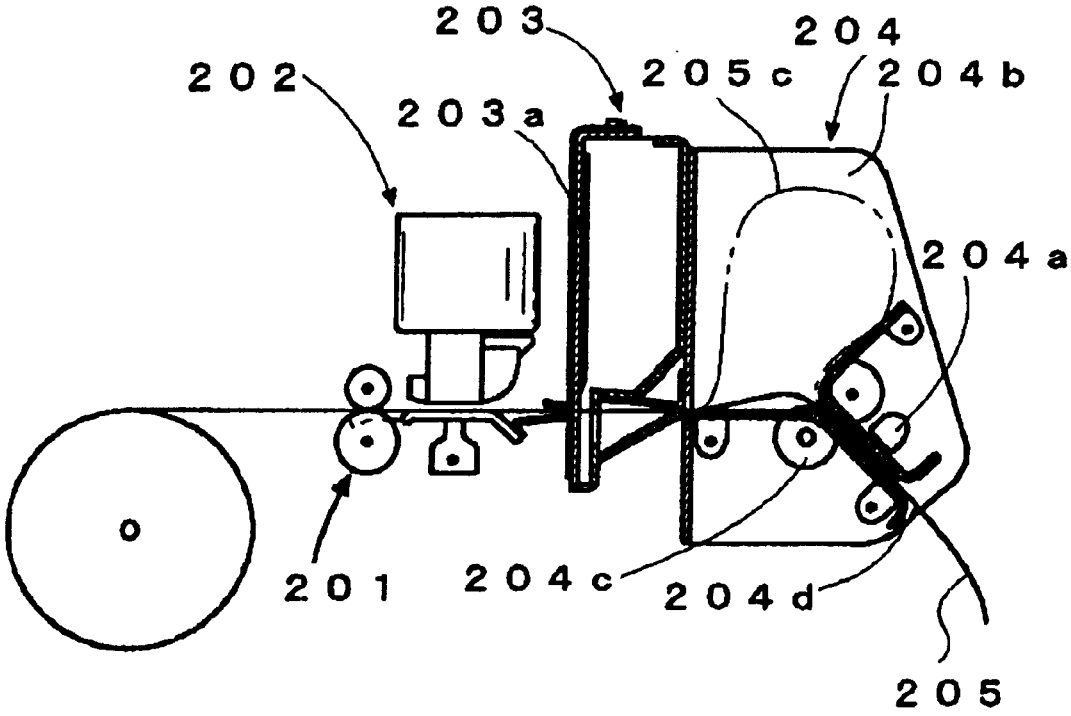
FIG. 10 PRIOR ART

In the case that the printed paper is not taken out from the paper taking out opening 4*d* within a predetermined period of time, the control circuit causes the paper winding roll 11 to rotate in the direction C in FIG. 7. Therefore, the paper sheet 17 is fed to the paper discharge space 16. When the first optical sensor 9 detects the passing of the rear end 17*b* of the paper sheet 17, the control circuit causes the motor to rotate until the paper sheet is completely discharged in the space 16, and thereafter the control circuit stops the roll 11. Thus, it is possible to prevent the printed paper sheet from being taken out by a third party.

During the operation, if an excessive load is applied on the paper winding roll 11, the clutch spring in the gear train slips, thereby stopping the paper winding roll. Consequently, failure of the power transmission system based on paper jamming are prevented.

In accordance with the present invention, the paper sheet is wound on the paper winding roll. Accordingly, the paper accumulation space in the conventional device is not provided. Consequently, the size of the device is reduced. Since the forward end of a long paper sheet enters the discharge space 16, the paper sheet can completely be stored in the discharge device regardless of the length of the printed paper sheet, the quality of paper and humidity without clogging of paper.

While the invention has been described in conjunction with preferred specific embodiment thereof, it will be understood that this description is intended to illustrate and not limit the scope of the invention, which is defined by the following claims.

What is claimed is:

1. A paper discharge device for a printer comprising:

a housing having a circular inside guide wall, a paper inlet, a paper taking out opening, a paper discharge opening, and a paper discharge space;

a paper winding roll rotatably provided in a space inside the circular inside guide wall;

a motor for rotating the paper winding roll;

a power transmitting device for transmitting power of the motor to the paper winding roll;

pressure rollers pressed against a periphery of the paper winding roll for winding a paper sheet on the paper winding roll;

the pressure rollers including a paper introducing roller and a paper discharge roller for discharging the paper sheet in the paper discharge space;

a first sensor for detecting a rear end of the paper sheet when the paper sheet is fed to the paper discharge opening;

a second sensor for detecting a forward end of the paper sheet when the paper sheet is fed to the paper taking out opening; and control means responsive to output signals of the first and second sensors for controlling operation of the motor.

2. The paper discharge device according to claim 1 further comprising a transmission power limit means provided in the power transmitting device for cutting the power transmission when an excessive load is applied on the paper winding roll.

3. The paper discharge device according to claim 1 further comprising a guide plate for guiding the forward end of the paper sheet into the paper discharge space.

* * * * *